United States Patent [19]

Hamson

[11] Patent Number: 4,972,651

[45] Date of Patent: Nov. 27, 1990

[54] CONTINUOUS CONSTRAINT PACKAGING METHOD AND APPARATUS

[75] Inventor: Karl L. Hamson, Pender Island, Canada

[73] Assignee: Western Packaging Systems, Ltd., Richmond, Canada

[21] Appl. No.: 233,205

[22] Filed: Aug. 17, 1988

[30] Foreign Application Priority Data

Aug. 17, 1987 [CA] Canada ..... 544639

[51] Int. Cl.[5] ..... B65B 5/06; B65B 43/52; B65B 39/00; B65B 67/02

[52] U.S. Cl. ..... 53/458; 53/468; 53/473; 53/491

[58] Field of Search ..... 53/443, 447, 458, 467, 53/473, 491, 535, 536, 242, 243, 247, 255, 260, 468

[56] References Cited

U.S. PATENT DOCUMENTS

| | | | |
|---|---|---|---|
| 1,243,406 | 10/1917 | Hawthorne | 53/243 X |
| 1,953,524 | 4/1934 | Woodward . | |
| 2,220,362 | 11/1940 | Anderson | 53/242 X |
| 2,727,664 | 12/1955 | Ardell . | |
| 2,734,323 | 2/1956 | Laub III . | |
| 2,804,738 | 9/1957 | Shenigo . | |
| 2,906,075 | 9/1959 | Vogel . | |
| 3,390,510 | 7/1968 | Crisci . | |
| 3,456,423 | 7/1969 | Helms | 53/242 X |
| 3,546,829 | 12/1970 | Lonergan | 53/260 X |
| 3,751,872 | 8/1973 | Helms | 53/242 X |
| 3,757,486 | 9/1973 | Feurston et al. . | |
| 3,762,129 | 10/1973 | Salomon | 53/242 X |
| 3,766,706 | 10/1973 | Graham | 53/260 X |
| 3,783,587 | 1/1974 | Kurtenbach . | |
| 3,805,484 | 4/1974 | Rossi . | |
| 3,808,770 | 5/1974 | Berney . | |
| 3,842,571 | 10/1974 | Focke et al. . | |
| 3,940,907 | 3/1976 | Ganz | 53/242 X |
| 4,018,031 | 4/1977 | Smaw . | |
| 4,211,056 | 7/1980 | Birk . | |
| 4,316,354 | 2/1982 | Loewenthal | 53/247 X |
| 4,506,493 | 3/1985 | Horton . | |
| 4,570,421 | 2/1985 | Focke et al. | 53/491 |
| 4,599,845 | 7/1986 | Luoni . | |

*Primary Examiner*—Horace M. Culver
*Attorney, Agent, or Firm*—John R. Uren

[57] ABSTRACT

A method of constraining a product while packaging and an apparatus to carry out the method. The product is positioned in a constraint cage having constraining fingers or plates on all four sides of the product in a first position. The constraint cage is then moved from the first position to a second position where packaging is performed by lowering a case over the product while the product is continuously constrained by either the cage or the case or both. Thereafter, the case is conveyed with the enclosed product while closing the major and minor flaps of the case.

7 Claims, 5 Drawing Sheets

CONTINUOUS CONSTRAINT PACKAGING METHOD AND APPARATUS

INTRODUCTION

This invention relates to a product constraining and packaging method and apparatus and, more particularly, to a product constraining method and apparatus for particular application to a case-over packaging operation.

BACKGROUND OF THE INVENTION

In packaging a product in cases, the product to be packaged typically must be conveyed from a first position where the product is collated into an array suitable for being placed in a case of a predetermined size to a second position where the product is typically moved sidewise into the case or the product is lowered or dropped from a position above the case into the case. The case is then sealed with the enclosed product and the case and product are then ready for transportation to a distribution centre.

If a product can be dropped into a case without damaging the product or the container, this method is satisfactory. Many products, however, cannot be dropped without the possibility of damage to the product or to the container holding the product. In using the sidewise loading method, one technique is to simply seal the case after moving the product into the case. This method, however, results in the flaps of the case being on the side of the case when the product is properly oriented which is unsatisfactory for the retailer. A second technique using side loading is to load the product into the case, seal the case and then rotate it such that the flaps are in the normally closed position on both the bottom and top of the case. Again, however, this results in rotating the product which, in some cases, may be unacceptable.

Where the product must be treated gently and minimal product movement is desired, a favoured technique is case-over packaging where the case is lowered over the product and the flaps are sealed. In this method, the product is subject to a minimum of movement, it retains its "right-side-up" orientation and the case has its closed flaps on the bottom and the top as is normal.

Existing case-over type machines, however, have problems when the product is moved relative to the case and, similarly, when the case is lowered over the product. When the product has a regular shape such as cereal boxes and the like, the consistency of positioning the case over the product without mishap is usually high. This is so since the rows and tiers of the array allow the product to be transported between the loading and packaging positions without any irregular and unexpected forces occurring which would tend to separate the various product boxes and destroy the array. This is similarly true when the case is moved to surround the product in the packaging position.

However, when the product is of an irregular shape such as when the product is, for example, cookie bags, the array is unstable with the result that it may collapse when it is being transported or when the case is lowered over the product in final packaging. The dislocation caused by the array collapse or displacement of the product during packaging can cause the packaging line to shut down or, at least, to be slowed. This is clearly unsatisfactory.

A system such as the system illustrated and described in U.S. Pat. No. 3,762,129 to Salomon discloses a constraint system which utilizes two stationary guide walls to constrain an irregularly shaped product in the form of tea bags from the product loading position to the case over packaging position. In addition, Salomon utilizes two sets of spacer fingers which move with the product and which constrain it until the case has been lowered over the product.

While the Salomon system is clearly an advance, it too remains unsatisfactory in at least one aspect. The guide walls are stationary rather than movable with the product. This causes friction between the product and the guide walls with the result that undesirable and unnecessary forces are created which tend, as mentioned, to cause the product array to collapse.

Yet a further problem with existing case-over packaging relates to the product support walls which support the product when the packaging takes place. When the case is lowered over the product, it is important that the product not protrude which can cause interference with the case when it is being lowered. Nor should the product constraint require small design tolerances which, when the tolerances are exceeded, can cause the case to hit the product constraint when it is lowered. Likewise, it is desirable to allow the product constraint used in previous machines to have some flexibility such that there will be increased tolerance when interference between the case and the product occur so as to allow the packaging operation to continue without product line shutdown or slowdown.

Yet a further disadvantage with existing packaging machines relates to the techniques which are used to close the bottom major and minor flaps of the case after it is lowered over the product. Typically, with either the major or minor flaps open on the product support rails, the case together with the product is conveyed through a plow frame which has a solid leading edge and which is angularly oriented relative to the flaps so that the flaps contact the leading edges which then force the flaps inwardly and close them. The angle of the leading edges of the plow is of considerable importance since if the angle is too shallow, the flaps will not fold under the case but, rather, they will jam against the leading edge of the plow. In order to provide for a leading edge which allows the flaps to be closed in all events, the included angle between the rollers must be relatively narrow which means the case may have to be transported over a relatively large distance before the flaps are entirely closed. This long distance is undesirable since speed is an important consideration in packaging operations.

Yet another disadvantage of existing packaging machines relates to case erectors. Previous case erectors have utilized a pair of grippers for the flaps which were located on adjacent sides of the case. Such a design, while offering good support to the two adjacent sides of the case, did not offer adequate support to the oppositely located sides. Such support is important in order to reduce misalignment of the case while the case is being lowered over the product for reasons discussed. A reduction in the misalignment of the case relative to the product reduces the possibility of interference between the product and the case.

Yet a further disadvantage with packaging machines and, in particular, with the case magazines of such machines, lies in the method and apparatus used to maintain the cases in contact with the separator bar which separates one case from the plurality of cases in the magazine. Previously, a walking beam type arrangement was used which, while it operated satisfactorily to keep the cases in contact with the separator bar, was costly because of numerous and extensive moving parts. The numerous parts also contributed to mechanical breakdown and the necessity for frequent maintenance and service operations.

SUMMARY OF THE INVENTION

According to one aspect of the invention, there is disclosed a case erector comprising a pair of spaced apart case retainers, a rotatable frame means for each of said case retainers and rotation means to simultaneously rotate each of said rotatable frame means, each of said case retainers being mounted on a respective rotatable frame means.

According to yet a further aspect of the invention, there is disclosed a method of erecting a case comprising grasping two opposite sides of a flat case with a pair of case retainers and opening said case by simultaneously rotating each of said case retainers.

According to yet a further aspect of the invention, there is provided a method of packaging a product comprising the steps of constraining said product in a constraining cage means, creating relative movement between said case and said product during movement from a first position where said case is remote from said product to a second position where said product is at least partially enclosed by said case and creating relative movement between said constraining cage means and said product to remove said product from said constraining cage means during said movement between said first and second positions.

According to yet a further aspect of the invention, there is disclosed a method of transferring a product from a first position to a second position comprising the steps of positioning a product within a constraining cage means having constraint means on at least three sides of said product in a first position and moving said constraining cage means with said product from said first position to a second position.

According to yet a further aspect of the invention, there is disclosed a product constraint apparatus comprising a product support, a constraint cage including a plurality of substantially vertically extending side members, means to move the upper portion of each of said side members between a first position where said cage is relatively larger and a second position wherein said cage is relatively smaller.

According to yet a further aspect of the invention, there is disclosed a method of packaging a product in a case having major and minor flaps comprising placing said product remote from said case on a product support, moving one of said case or product relative to the other of said case or product until said product is wholly within said case while moving said major flaps outwardly and positioning the minor flaps of said case in a position normal to said major flaps, moving said case to a second position while closing said minor flaps and moving said case from said second position to a third position while closing said major flaps.

According to yet a further aspect of the invention, there is provided a method of closing the flaps of a case comprising the steps of moving said case from a first position to a second position, said case having a pair of substantially vertical open flaps in said first position, contacting said flaps at a position adjacent the crease line between said flaps and said case with an angular plow having a rotatable roller along at least a portion of its leading edge and closing said flaps while moving said case to said second position.

According to yet a further aspect of the invention, there is provided a plow for a case packaging system comprising a member, said member having at least one leading edge and a rotatable cylinder mounted to said leading edge.

According to yet a further aspect of the invention, there is provided a finger operable for use in a packaging apparatus comprising a substantially rigid longitudinal first member and a top assembly connected to one end of said first member, said top assembly having a portion extending outwardly from said first member at a predetermined angle.

According to yet a further aspect of the invention, there is provided a case erector comprising a case magazine operable to receive a plurality of flat cases in a substantially vertical position, separator means at one end of said magazine to separate one of said cases from said plurality of flat cases and at least one rotatable lead screw below said plurality of cases being operable to contact the bottom of at least some of said plurality of flat cases and to advance said cases towards said separator means.

According to yet a further aspect of the invention, there is disclosed a method of continuously advancing flat cases within a case magazine towards one end of said magazine, said method comprising rotating at least one lead screw beneath said magazine while said screw is in contact with at least some of said cases to urge said cases towards one end of said magazine.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
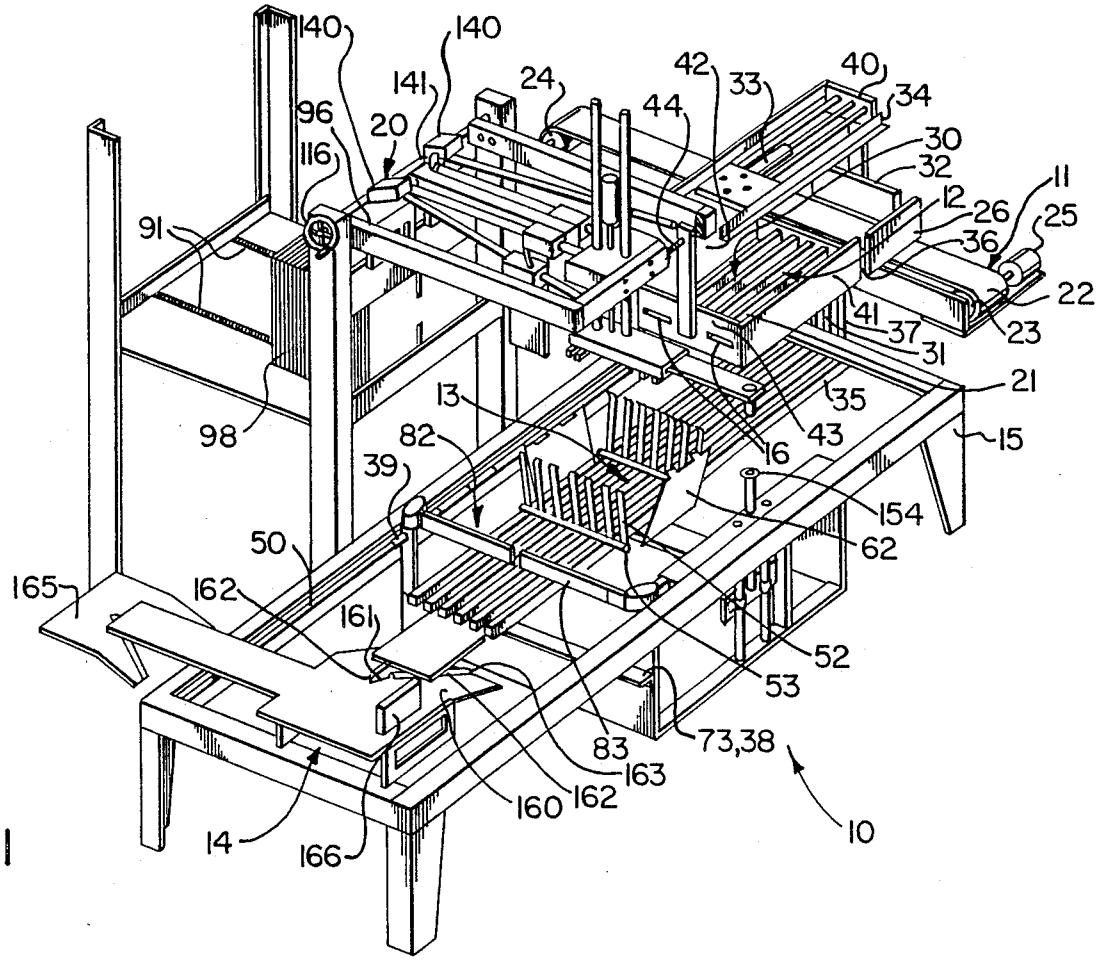
FIG. 1 is an isometric view of the packaging apparatus according to the invention.

Referring now to the drawings, a packaging apparatus is shown generally at 10 in FIG. 1. It comprises a product conveyor infeed apparatus generally illustrated at 11, an elevator assembly and product collator apparatus generally shown at 12, a constraint cage generally shown at 13, a flap plow generally illustrated at 14 and a case erector generally illustrated at 20.

The product conveyor infeed apparatus 11 comprises an endless belt 22 movable between drive and idler pulleys 23,24 respectively, drive pulley 23 being movable under the influence of an electric motor 25. The belt 22 proceeds in the direction indicated which is normal to the direction of the plurality of longitudinal elevator rails 30 which are individually attached to and removable from an elevator frame (not shown) and which form the floor of an elevator 21. The belt 22 is positioned slightly above the level of the rails 30 of the elevator 21 such that the product being conveyed on the belt 22 may move off the belt and onto the elevator rails 30 without encountering interference.

The elevator 21 is movable in the direction indicated under the influence of an air cylinder and rod 31 between a first raised position where the rails 30 are slightly below the level of the belt 22 and a second lowered position in which the elevator rails 30 are substantially parallel and conterminous with the product support rails 35. The air cylinder and rod 31 is operable to be stopped in a plurality of positions between the raised and lowered positions of the elevator 21 such that the product may be stacked on the elevator 21 in a predetermined number of vertical tiers.

Figure 2:
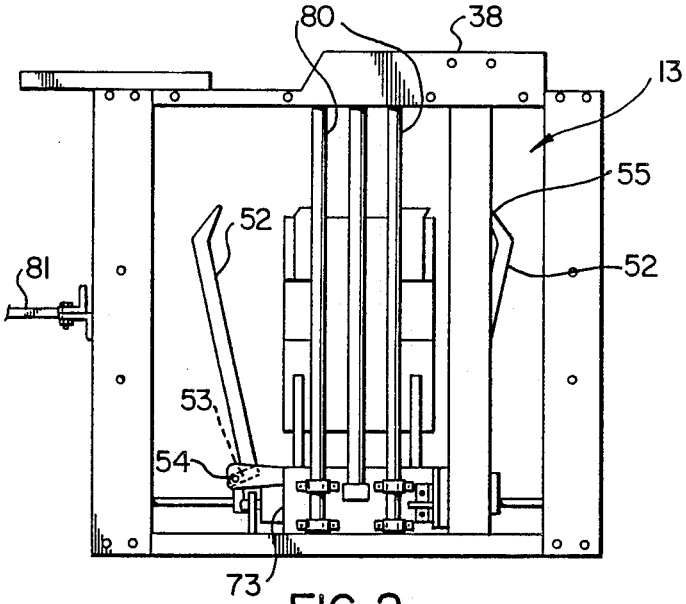
FIG. 2 is a diagrammatic side view of the constraint cage with the fingers in the open or receiving position.
Figure 3:
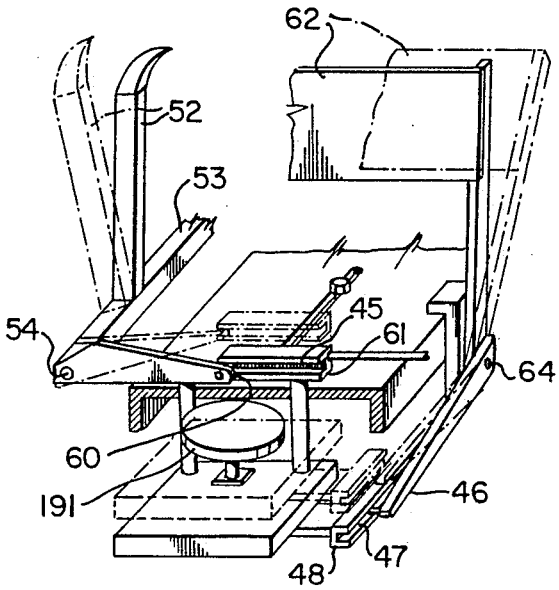
FIG. 3 is an isometric view of the fingers of the constraint cage illustrating the opening and closing mechanism.

The product collator apparatus includes a pusher bar 32 movable on guide shafts 34 by way of linear bearings 40 and under the influence of an air cylinder 33 between a first position just outside the endless belt 22 and a second inner position which is adjustable depending on the number of rows of product it is desired to position on the elevator 21. First and second vertical members 41 (only one of which is shown) respectively, also make up the product collator apparatus as well as an end plate 43 which is connected to an upper adjustment member in the form of a lead screw 44 which can be moved inwardly or outwardly under the influence of an adjustment wheel (not shown) which rotates the lead screw 44. An adjustment by way of slots 16 in the end plate 43 is also provided for the first and second vertical members 41. The constraint cage 13 is movable in the direction indicated in FIG. 1 and is located below the elevator 21 when the elevator 21 is in its raised position. With particular reference to FIGS. 2 and 3, the constraint cage 13 comprises a plurality of fingers 52 mounted on two rotatable frames 53 (only one of which is shown), each of the rotatable frames 53 being pivotal about an axis 54 with a cam follower 60 extending from each of the rotatable frames 53. The cam followers 60 are mounted within a cam 45 machined within a bracket 61. A pair of end plates 62 are likewise mounted to respective rotatable frames 63 and these frames 63 are pivotally mounted about axes 64. A cam follower 46 is mounted on the end of each of the frames 63. This follower 46 is likewise movable on a cam 47 machined within a bracket 48. Brackets 48,61 are operable to reciprocate vertically under the influence of an air cylinder 191. Thus, as the air cylinder moves the brackets 48,61 vertically, the cam followers 47,60 will also move vertically thus causing the end plates 62 and the fingers 52 to pivot outwardly and inwardly about their respective axes 54,64 and opening and closing the top of the constraint cage 13.

Figure 4A:
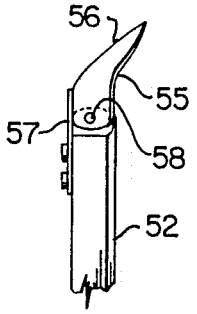
FIGS. 4A, 4B and 4C illustrate embodiments of the top assemblies for the fingers of the constraint cage.

A top assembly generally illustrated at 55 (FIG. 4) is connected to each of the fingers 52 and the end plates 62. The top assemblies 55 include a first relatively rigid portion 56 which resists a downwards vertical force and a second relatively flexible portion 57 which allows the top assembly 55 to move outwardly if a horizontal force is applied to the rigid portion 56.

Figure 5:
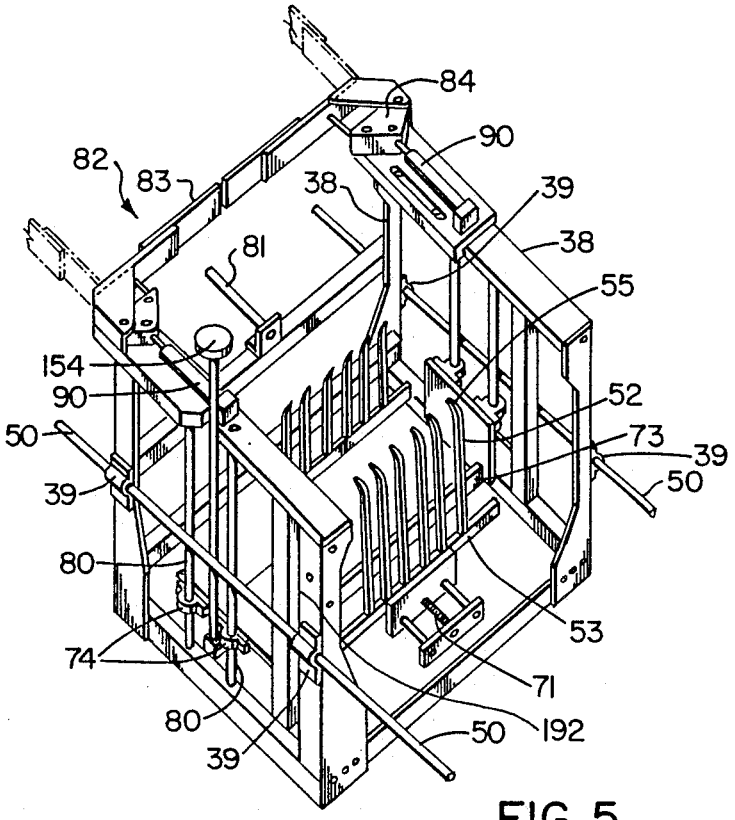
FIG. 5 is an enlarged diagrammatic isometric view of the constraint cage and holding frame.

The frames 53 for the fingers 52 and the frames 63 for the end plates 62 are adjustable by way of respective lead screws 71 (FIG. 5). In so adjusting the end plates 62, it may be necessary to add or remove one or a number of product support rails 35. Thus, the size of the constraint cage 13 may be adjusted depending upon the size of the product which it is intended to package.

As clearly seen in FIG. 1, the fingers 52 of the constraint cage 13 are intended to extend through the elevator rails 30 as the elevator 21 is lowered to the position where its rails 30 are substantially conterminous with the product support rails 35. The rails 30 of the elevator 21 are individually removable from the elevator frame and the fingers 52 of the constraint cage 13 are likewise individually removable from their respective frames 53. This feature allows for adjusting the size of the constraint cage 13.

A sensor (not shown) in the form of a proximity switch is mounted adjacent the position of the elevator 21 in its lowered position. The sensor is operable to indicate when the elevator 21 has reached its lowermost position.

The constraint cage 13 is mounted on a constraint cage frame 73 (FIG. 5). The constraint cage frame 73 is mounted on two linear bearings 74 on each side of the constraint cage 13, the linear bearings 74 travelling on a pair of guide rails 80 mounted on opposite sides of the constraint cage frame 73 and within a constraint cage holding frame 38. The constraint cage frame 73 reciprocates on the guide rails 80 under the influence of an air cylinder 192 between a first position in which the constraint cage 13 is raised and its fingers 52 extend through the product support and elevator rails 35,30 respectively and a second position in which the constraint cage 13 is lowered below the product support and elevator rails 35,30.

The constraint cage holding frame 38 likewise has two linear bearings 39 on each side and these linear bearings 39 are movable on guide rails 50 under the influence of an air cylinder and rod 81 connected to the holding frame 38.

Two paddle assemblies generally illustrated at 82 in FIG. 1 are also mounted to and move reciprocally with the holding frame 38. The paddles 83 (more clearly shown in FIG. 5) of the paddle assemblies 82 are mounted above the product support rails 35 and pivot about axis 84 under the influence of one air cylinder 90 for each paddle 83, between open and closed positions. The paddles 83 are operable to close prior to the constraint cage 13 moving to the case-over packaging position. They are operable to push a loaded case along the product support rails 35 from the case-over position through the plow 14 simultaneously with the movement of the constraint cage 13 into the case-over packing position as will be described in greater detail hereafter.

Figure 6A:
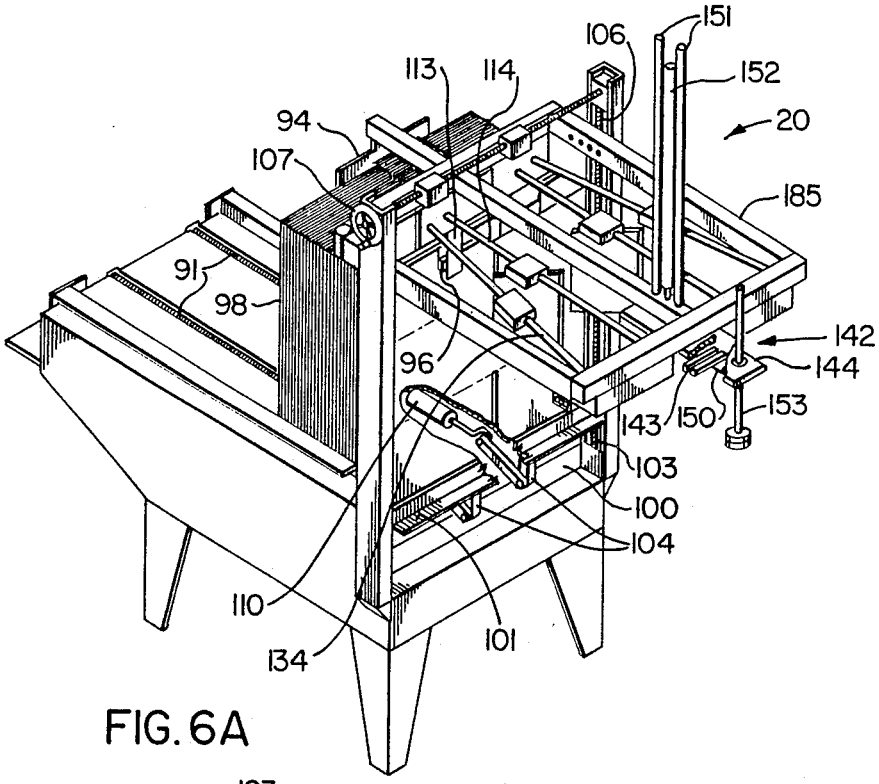
FIGS. 6A and 6B are, respectively, isometric views of the erector apparatus and the case advancement lead screws.
Figure 6B:
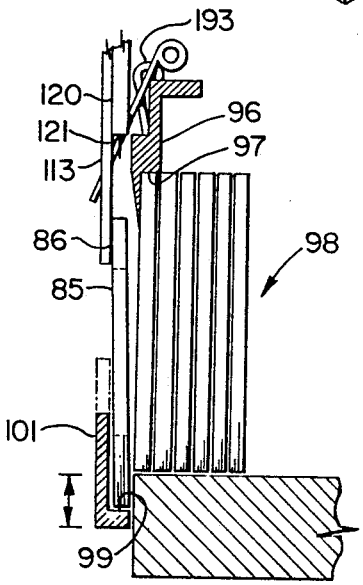

The case erector 20 is shown in greater detail in FIGS. 6A and 6B. A pair of lead screws 91 are each connected to a crank 92 which is connected with a one way clutch 93 connected to each of the cranks 92. The cranks 92 are each operable by a respective air cylinder 90 which reciprocates the cranks 92 connected to the lead screws 91 and, thereby, turns the lead screws 91.

A case pusher 94 is mounted in the upper portion of the case erector 20. The case pusher 94 is connected to an air cylinder (not shown) which is pressure adjustable so as to keep the case pusher 94 in contact with the cases 98. The case pusher 94, together with the lead screws 91, apply pressure to the stack of cases 98 which are thereby constantly pushed against the separator bar 96 and the injector bar 101.

The separator bar 96 (shown more clearly in FIG. 7) has a step 97 which allows only one of the cases 98 to be moved at a time by the separator bar 96. The bar 96 reciprocates vertically on a pair of guide rods (not shown) in the direction indicated under the influence of an air cylinder (not shown). The height of the separator bar 96 is adjustable by way of a lead screw 106 (FIG. 6A).

The injector bar 101 is mounted on linear bearings (not shown) on each side of the injector bar 101. The linear bearings reciprocate vertically on guide rods 103. The injector bar 101 is movable by a pair of identical cranks 104 which move under the influence of an air cylinder 110.

A pair of calipers 113 are mounted on dual shafts 114. The calipers 113 are mounted on the side of the case erector 20 opposite from the side of the injector and separator bars 101, 96, respectively, on which the cases are pressed by the lead screws 91 and the case pusher 94. The calipers 113 are biased such that opposed flaps of the unerected or flat cases 98 are driven by the injector bar 101 into pin blocks 120 (FIG. 7) where the flaps are driven onto pins 121. The operation of the pins 121 and the pin blocks 120 are disclosed more fully in our U.S. Pat. No. 4,553,954 entitled AUTOMATIC CASE ERECTOR AND SEALER dated Nov. 19, 1985.

The case retainers in the form of pin blocks 120 are spaced apart and each mounted on a rotatable bracket 122 (FIG. 8) which is, in turn, connected to a rotatable shaft 123 which is mounted in a pin block frame 124. The pin block frames 124 are connected together by a shaft 125 and an adjustment block 126. An air cylinder (not shown) is connected to the adjustment block 126 and moves the pin block frames 124 reciprocally on linear bearings 130 movable on parallel guide rails 131.

Figure 8:
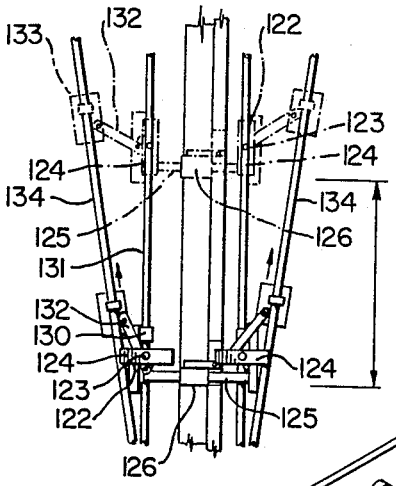
FIG. 8 is a partial plan view of the case erector mechanism wherein diverging guide rails are used.

A rotation means in the form of a movable arm 132 is connected to each of the rotatable brackets 122. Each arm 132 is pivotally mounted on a bearing block in the form of a guide rail frame 133, each of the guide rail frames 133 being movable on a guide rail 134. The respective guide rails 134 diverge from their attachment positions adjacent and above the separator bar 96 as shown at the bottom of FIG. 8. As the guide rail frames 133 move on the diverging guide rails 134, the arms 132 will simultaneously rotate each bracket 122 and, therefore, the attached pin blocks 120 and the pins 121 which grip the opposite flaps of a case.

The guide rails 134 together with the guideshafts 131 are adjustable to accommodate a wide range of case sizes. The end of each guide rail 134 and each guideshaft 131 are mounted on a bracket 140 and each bracket 140 is movable on respective lead screws 141. Each lead screw 141 is rotatable with a hand crank 116 which will move the brackets 140 closer together or further apart with the result that cases of different sizes may be utilized.

The stripper mechanism is illustrated generally at 142 (FIG. 6A). It is located at the diverging end of the guide rails 134 and above the case when the case reaches its fully open position. A pair of grippers 143 are adjustably mounted to the stripper frame 144. The grippers 143 open and close under the influence of air cylinders 150 and are operable to grip the flaps of an erected case.

The stripper frame 144 is vertically movable on guide rods 151 under the influence of an air cylinder 152. A contact rod 153 is mounted in the stripper frame 144 and is operable to contact a complementary stop 154 on the constraint cage frame 38 (FIG. 5).

The plow 14 (FIG. 1) comprises a plate 160 extending downwardly at an angle of approximately 15 degrees. A v-shaped opening 161 in the plate 160 has an included angle between the forward edges of the opening 161 of approximately 90 degrees. A pair of rollers 162 are mounted to the leading edges of the opening 161 with bearings 163 mounted to the plate 160 such that the rollers 162 are freely rotatable in their bearings 163.

OPERATION

In operation and with reference to FIG. 1, the product to be packaged will proceed along the endless belt 22 of the product conveyor infeed apparatus 11 until it reaches the stop 26 which is a part of the pusher bar 32. As the products back up against the stop 26 of the pusher bar 32, a sensor (not shown) senses when the correct length of the backed up products is reached and so signals the pusher bar 32. The air cylinder 33 pulls the pusher bar 32 with the single row of product onto the elevator rails 30 of the elevator 21. The pusher bar 32 moves only a certain predetermined distance on each stroke, which distance is adjustable.

As the pusher bar 32 moves the first row of product off the endless belt 22 and onto the elevator rails 30, a second row of product has reached a second stop (not shown) on the pusher bar 32 and is proceeding to back up against this second stop. When the pusher bar 32 returns to its home position as illustrated in FIG. 1, the product will be released by the second stop, travel down the endless belt 22 and again contact the stop 26. When the quantity of product is sufficient to fill a second row, the sensor will again signal the pusher bar 32 to move the next row of product onto the rails 30 of the elevator 21. This procedure continues until the desired number of product rows have been positioned on the elevator 21.

When the elevator 21 has been filled with product, the elevator 21 moves vertically downwardly under the influence of air cylinder 31 and being guided by guide rods 37. It may move down in steps in accordance with the number of tiers of product desired and, if so, the product loading just described will be repeated at each step.

The constraint cage 13 is positioned directly beneath the elevator 21 and will move upwardly on guide rails 80. The fingers 52 and the end plates 62 will be in a position where they are inclined outwardly on all sides at an angle of approximately 15 degrees with the vertical. This outwardly inclined position of the fingers 52 and the end plates 62 is obtained by the action of the cam followers 60,46 (FIG. 3) of the fingers 52 and end plates 62 on the cams 45,47 in brackets 61,48, the brackets 61,48 being moved by an air cylinder (not shown) when an appropriate signal is received by the air cylinder.

As the elevator 21 moves downwardly, the elevator rails 30 will interleave with the upwardly directed fingers 52 and end plates 62 of the constraint cage 13. The end plates 62 will extend upwardly on opposite sides of the constraint cage 13 and on those sides which do not contain the fingers 52.

When the elevator 21 reaches its fully down position, the elevator rails 30 will be interleaved with and parallel to the product support rails 35. The product on the elevator 21 will be encased totally within the constraint cage 13 and resting simultaneously on both the elevator rails 30 and the product support rails 35.

The air cylinder will then move the brackets 61, 48 downwardly together with the cams 45,47 and the cam followers 60,46. Consequently, the end plates 62 and fingers 52 move inwardly until they are in a substantially vertical position while closely constraining the product.

An appropriate signal activates the air cylinder and rod 81 (FIG. 5) which then moves the constraint cage holding frame 38 together with the constraint cage 13 and the product enclosed within the constraint cage 13 off the elevator rails 30 to a position where they are supported solely by the product support rails 35. The constraint cage holding frame 38 is moved by the air cylinder and rod 81 to a position directly below the case erector 20 as seen in FIG. 1. As the constraint cage 13 moves the product over the product support rails 35, the paddles 83 of the paddle assembly 82 are activated by respective air cylinders 90 and close to the position illustrated in FIG. 5. In the closed position, they will push a case previously packed out of its position beneath the case erector 20 and into the plow 14.

Figure 7:
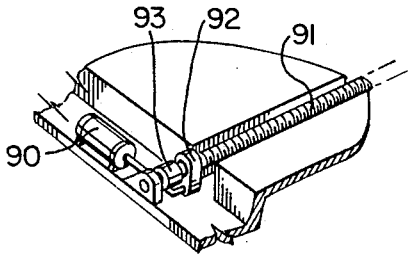
FIG. 7 is a diagrammatic and enlarged side view of the separator and injector bars used with the case magazine.

A stack of flat cases 98 are meanwhile pressing against the separator bar 96 and the injector bar 101 by the action of the rotating lead screws 91 and case pusher 94 (FIG. 6A). As seen in FIG. 7, the separator bar 96 will move a single case 85 at a time downwardly into contact with the step 99 on the injector bar 101, the separator bar 96 then returns to the "up" position shown. The top of the case 85, being then free from the separator bar 96, will move upwardly until it contacts the calipers 113 on the side of the separator bar 96 opposite from the side on which the stack of cases 98 bear. As the injector bar 101 continues to rise, the flaps 86 of the case 85 are pushed into a wedge shaped opening defined by the calipers 113 and a set of flat springs 193 which opening contains the pins 121 on the pin blocks 120.

The flaps 86, in this case, the major flaps, will then be "injected" into the pins 121 and the case 85 will be securely held by the pins 121. An appropriate signal is then sent to the air cylinder (now shown) which initiates movement of the adjustment block 126 and, therefore, the pin block frames 124 (FIG. 8).

As the pin blocks 120 are rotated by the rotatable brackets 122 under the influence of the movable arms 132 connected between the rotatable brackets 122 and the guide rail frames 133 on the diverging guide rails 134, the pins 121 will pull the flaps of the case on opposite sides of the case open from their previously closed condition and the case will become "erected" into an open position with the minor and major flaps on both the top and bottom being in their extended and separated condition. It will also be noted that the major flaps held by the pins 121 will be located on opposite sides. That is, the flaps of the case that will be held by the pins 121 will be the pair of major flaps of the case 85.

The stripper mechanism generally illustrated at 142 in FIG. 6A is then activated by appropriate sensors. Air cylinder 152 will commence the downwardly movement of the stripper frame 144 on guide rods 151 with the attached grippers 143. The grippers 143 will grasp, under the influence of air cylinders 150, the minor flaps of the case 85 which minor flaps are not held by the pins 121. As the frame 144 continues to move downwardly, the case is stripped off the pins 121 and the pins 121 and the pin blocks 120 are moved to their home position adjacent the separator bar 96 awaiting the arrival of a subsequent case. The bottom flaps of the case will initially contact the top assemblies 55 of the fingers 52 and the end plates 62. The relatively rigid portion 56 of the top assemblies 55 will deflect the flaps outwardly from their previous substantially vertical position as the case 85 is lowered over the constraint cage 13.

Following the flaps of the case being deflected by the top assemblies 55 of the fingers 52, the body of the case 85 is guided to a position exactly above the product array by the natural guiding action of the outwardly angled flaps deflected by the top assemblies 55 of the fingers 52. At the point where the central portion of the case 85 begins to move downwardly over the constraint cage 13, the contact rod 153 (FIG. 6A) connected to the stripper frame 144 will contact the stop 154 mounted to the constraint cage 13. As the stripper frame 144 continues downwardly, the constraint cage 13 will also move downwardly with the contact rod 153 of the stripper frame 144 in contact with the stop 154 of the constraint cage 13. The top assemblies 55 will rotate slightly about axis 58 as they move downwardly over and contact the product in the constraint cage 13. Thus, the product is continuously constrained during the case-over packaging operation, initially by the fingers 52 and end plates 62 of the constraint cage 13 and, thereafter, with the case 85 itself. Following the completion of the case-over packaging operation, the constraint cage holding frame 38, under the influence of the air cylinder and rod 81, will be returned to its position directly below the elevator 21 awaiting the commencement of the operating sequence on the next case.

The major flaps of the case 85 are extending outwardly from the case 85 in contact with and substantially horizontal on the product support rails 35 and the minor flaps of the case 85 extend downwardly from the case 85 outside both sides of the product support rails 35.

The constraint cage holding frame 38 will then move with a constrained product within the constraint cage 13 from the position below the elevator 21 along the product support rails 35. The paddles 83 are closed by air cylinders 90 and, as the constraint cage holding frame 38 moves into the case-over packaging position, the paddles 83 will contact the case 85 and move it into the plow 14. The minor flaps of the case 85 will contact the rollers 162 of the plow 14 and, because the rollers 162 are freely rotatable, the flaps will be smoothly deflected upwardly into a substantially horizontal closed position where they directly contact and support the product in the case 85. Following the completion of the minor flap closing operation, the case will be conveyed by a paddle 166 into a second plow 165 oriented 90 degrees to the first plow, to close the bottom major flaps in a manner similar to that used for the minor flaps. At this point, the filled case is dislodged ready for final flap sealing operations, machines for which are well known in the art and which are not here described.

Figure 9:
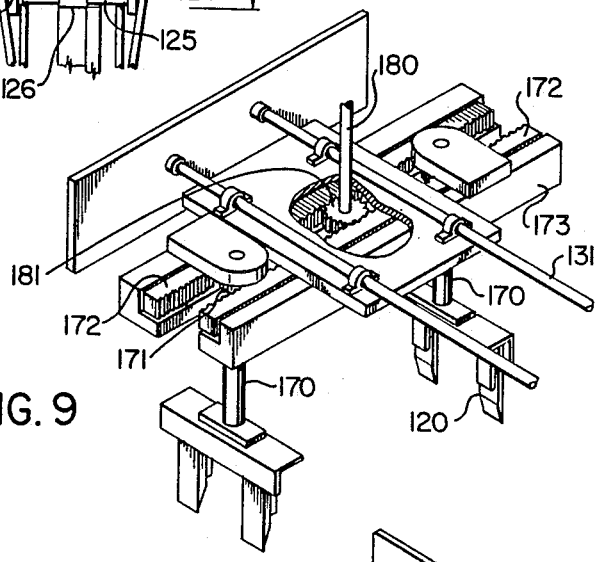
FIG. 9 is an isometric view of a further embodiment of the case erector utilizing a rack and pinion type case opening apparatus.

A further embodiment of the case erector 20 is illustrated in FIG. 9. In this embodiment, the movable pin blocks 120 of the FIG. 8 case erector embodiment are not rotated by the action of diverging guide rods 134 and movable arms 132. Rather, the pin blocks 120 are each mounted to a shaft 170 and a pinion 171 (only one of which is shown) is mounted to each shaft 170. Each pinion 171 meshes with its own rack 172, the racks 172 being mounted in an opposed relationship in a rack frame 173.

A rack frame 173 retains the racks 172 and allows them movement relative to each other and also to the rack frame 173. A shaft 180 extends through the rack frame 173 and a further pinion 181 is positioned on the end of the shaft 180 so as to mesh with each of the racks 172. A shaft arm 182 (FIG. 10) is coupled to the shaft 180 so as to rotate the shaft 180 and pinion 181 when the shaft arm 182 is rotated and a recess or slot 183 in the shaft arm 182 allows for movement of a pin 184 which is stationary on the frame 185 of the case erector 20. Thus, when the rack frame 173 moves on the guide shafts 131 under the influence of an air cylinder (not shown), the shaft arm 182 will be rotated by the stationary pin 184. The rotation of the shaft arm 182 will rotate the shaft 180 and its pinion 181 which will then move the racks 172 in opposite directions. Since the pinions 171 mesh with opposite racks 172, the pin blocks 120 will also rotate and open or "erect " the case.

An adjustment for cases of different dimensions in the FIG. 9 embodiment is also provided by allowing for movement of the racks 172 relative to the rack frame 173 in which the racks 172 are mounted. The shaft arm 182 may be coupled and uncoupled from the shaft 180 to allow for the rack-rack frame adjustment for cases of different sizes.

Figure 10:
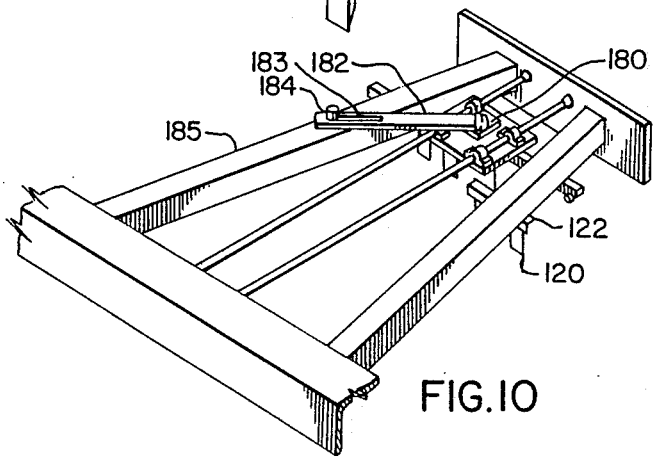
FIG. 10 is an isometric assembled view of the FIG. 9 embodiment.

Yet a further embodiment of the case erector 20 is contemplated. In this embodiment, the rotatable brackets 122 of the FIG. 8 embodiment are utilized but, rather than utilizing the diverging guide rails 134, the shaft arm 182 and stationary pin 184 illustrated in FIG. 10 are used. In this embodiment, there would be, of course, a shaft arm 182 for each pin block 120 similar to the movable arm 132 provided for each rotatable bracket 122 in the FIG. 8 embodiment.

It will be seen by the description given above that the case erector 20 is versatile in that it may grasp either the major or minor flaps of the case 85. Similarly, the case erector 20 may be used for either left hand or right hand cases by simple adjustments to the pin blocks 120 and their rotating mechanisms such that rotation takes place in a direction opposite to the direction described. Finally, the case erector may also be used with half-slotted cases where the case is dropped to a predetermined height by the stripper frame 144 and is subsequently conveyed through the plows to close the bottom flaps in the normal manner.

Adjustments are possible in the apparatus according to the invention to accommodate different sized products and cases. The size of the elevator and the product collator 12 may be adjusted according to the size of the product desired to be carried by the case. The size of the constraint cage 13 is adjustable as earlier described and the size of the case erector 20 is also adjustable as described to allow for cases of different dimensions.

Figure 4B:
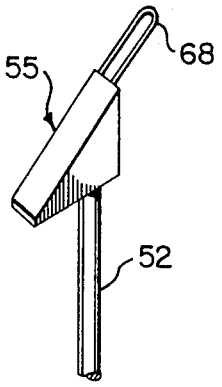
Figure 4C:
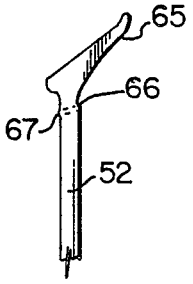

A further embodiment contemplated for the top assemblies 55 is illustrated in FIGS. 4B and 4C. Rather than the single member rotatable about axis 58, a flat wire assembly 65 illustrated in FIG. 4C is provided. In this embodiment, the flat wire assembly 65 is mounted in a step 66 and groove 67 on the finger 52 and is shaped so as to provide a rigid area to a downwards force and a flexible area to a horizontal force. Yet a further embodiment shown in FIG. 4B contemplates a round wire member 68 extending from the top assembly 55 attached to finger 52.

Many further modifications of the apparatus described are possible according to the invention and will readily occur to those skilled in the art. The specific embodiments described and illustrated, therefore, should be considered as illustrative only and not as limiting the scope of the invention as defined in accordance with the accompanying claims.

I claim:

1. A method of packaging a product comprising the steps of positioning said product in a cage, closing at least a portion of the cage to removably restrain said product in the cage, creating relative movement between a case and the restrained product to encase said product with said case and creating relative movement between said cage and said product to remove said product from said cage during said encasement of the product.

2. The method of claim 1 wherein said product is stationary and said case and said cage moves relative to said product.

3. The method of claim 1 wherein said case is lowered over said product and said cage moves downwardly relative to said product simultaneously while said case is lowered over said product.

4. The method of claim 1 wherein said product is restrained within said cage in a first location and moving said cage with said product from said first location to a second location.

5. The method of claim 4 wherein said product is restrained by four substantially vertical side members and a bottom rail member by pivoting each vertical side member about an axis located at the bottom portion thereof to move the side members from an open position wherein each of said vertical side members slopes outwardly from said product and are angled outwardly from a vertical position to a closed vertical position in which the product is restrained by the vertical side members.

6. A method of packaging a product in a case having major and minor flaps comprising placing said product remote from said case on a product support, moving one of said case or product relative to the other of said case or product until said product is wholly within said case while moving said major flaps outwardly substantially at right angles to the sides of said case and positioning the minor flaps of said case in a position normal to said major flaps, moving said case to a second position while closing said minor flaps and moving said case from said second position to a third position while closing said major flaps.

7. The method according to claim 6 wherein said case is lowered over said product.

* * * * *